US006391428B1

(12) United States Patent
Ueno et al.

(10) Patent No.: US 6,391,428 B1
(45) Date of Patent: May 21, 2002

(54) INK JET RECORDING SHEET

(75) Inventors: Takashi Ueno; Noboru Kondo; Akinobu Chatani; Yoshihiro Kuroyama, all of Tokyo (JP)

(73) Assignee: Nippon Paper Industries Co. Ltd., Tokyo (JP)

( * ) Notice: Subject to any disclaimer, the term of this patent is extended or adjusted under 35 U.S.C. 154(b) by 0 days.

(21) Appl. No.: 09/457,625

(22) Filed: Dec. 8, 1999

(30) Foreign Application Priority Data

| | | |
|---|---|---|
| Dec. 8, 1998 | (JP) | 10-348016 |
| Feb. 26, 1999 | (JP) | 11-050608 |
| Mar. 15, 1999 | (JP) | 11-068553 |

(51) Int. Cl.[7] ..... B41M 5/00
(52) U.S. Cl. ..... 428/195; 428/328; 428/331
(58) Field of Search ..... 428/195, 207, 428/323, 328, 331, 409, 211

(56) References Cited

U.S. PATENT DOCUMENTS

| | | | | |
|---|---|---|---|---|
| 4,460,637 A | | 7/1984 | Miyamoto et al. | 428/212 |
| 6,139,940 A | * | 10/2000 | Iwamoto et al. | 428/195 |

FOREIGN PATENT DOCUMENTS

| | | | |
|---|---|---|---|
| EP | 0 275 711 A1 | 7/1988 | |
| EP | 0 500 021 A1 | 8/1992 | |
| EP | 0 663 300 A1 | 7/1995 | |
| JP | 57-087988 | 6/1982 | B41M/5/00 |
| JP | 61-146591 | 7/1986 | B41M/5/00 |
| JP | 63-222885 | 8/1988 | B41M/1/26 |
| JP | 5-051469 | 3/1993 | C08J/7/04 |
| JP | 6-092011 | 4/1994 | B41M/5/00 |
| JP | 7-32725 | 2/1995 | |
| JP | 7-032725 | 2/1995 | B41M/5/00 |

* cited by examiner

*Primary Examiner*—Bruce H. Hess
(74) *Attorney, Agent, or Firm*—Gary C. Cohn PLLC

(57) ABSTRACT

The objective of this invention is to provide a recording material that can be recorded by ink with water-soluble dye, particularly to provide an ink jet recording sheet, which provides an excellent combination of in ink absorbency, ink coloration, light resistance, water resistance and surface gloss.

One subject of the invention is an ink jet recording sheet having on an ink-receiving support an image preserving layer comprising anionic colloidal silica and zinc oxide particulates with an average particle size of about 15 to 380 nm and having a 75 degree specular glossiness of at least about 25% at the surface. Another subject of the invention is an ink jet recording sheet having on an ink-receiving support, in succession, an image preserving layer comprising anionic colloidal silica and zinc oxide particulates with an average particle size of about 15 to 380 nm and a fixing layer comprising cationic colloidal silica and cationic polymer electrolyte.

20 Claims, No Drawings

INK JET RECORDING SHEET

FIELD OF THE INVENTION

The present invention relates to a recording material that can be print on with ink containing water-soluble dye. In particular, the present invention relates to an ink jet recording sheet which provides a superior combination of ink absorbency, ink coloration, resistance of the recorded image to light, resistance of the recorded image to water and surface gloss.

PRIOR ART

Ink jet recording is a method by which fine ink drops are jetted out using any kind of jetting method to form an image on a recording material. Since this method enables a recording apparatus to be operated at a high speed and the apparatus is generally inexpensive, the use of ink jet recording systems has been spreading rapidly. Moreover, the use of multicolor ink jet recording methods enables the formation of color images comparable to silver-salt films with high resolution and high quality. Digital images, for example those obtained by a digital camera, are increasingly printed with an ink jet printer. The recorded materials are more often being displayed or stored for considerably long period because of the high image quality. Therefore, it is desirable that the ink jet recording materials have good preservation characteristics, especially good light resistance, as well as high image quality.

Ordinary ink jet recording sheets, printed by an ink jet printer, are discolored by the UV light in the sunlight or fluorescent lamps. Therefore some countermeasures for this problem have been attempted to improve the long-term preservation properties of the sheet. Although some attempts utilized a pigment ink system with a pigment resistant to discoloration, in most instances it is attempted to improve the light resistance by using a dye ink system because dye ink system provide sharper images.

As examples of means to improve the light resistance, for example, a process to add UV absorber such as benzophenones and benzotriazoles (Japanese Tokkai Sho 57-87988 and Japanese Tokkai Sho 63-222885, "Tokkai" means an "unexamined published patent application"), a process to add antioxidant such as hindered amines (Japanese Tokkai Sho 61-146591), a process to add zinc oxide and cationic resins concurrently (Japanese Tokkai Hei 7-32725) and the like have been disclosed. However, since these additives are difficult to disperse evenly in the materials, these attempts did not provide a satisfactory improvement.

As a method to attain the high image quality by increasing the gloss of the recording sheet, for example, a process to use cationic colloidal silica (Japanese Tokkai Hei 6-92011) has been proposed, but this process can not provide a sufficient balance between the image quality and the image preservation.

Moreover, a process to improve the water resistance of the recording layer by setting up a coating layer comprising a colloidal silica that couples like beads and a water-soluble polymer (Japanese Tokkai Hei 5-51469) have been proposed, but this process can not achieve sufficient water resistance and its light resistance is still insufficient.

PROBLEMS ENCOUNTERED

The objective of this invention is to provide a recording material that can be recorded by ink with water-soluble dye, particularly to provide an ink jet recording sheet, which is superior in ink absorbency, ink coloration, light resistance, water resistance and surface gloss.

SUMMARY OF THE INVENTION

One subject of the present invention is an ink jet recording sheet having on an ink-receiving support an image preserving layer comprising anionic colloidal silica and zinc oxide particulates with an average particle size of about 15 to 380 nm and having a 75 degree specular glossiness of at least about 25% at the surface. Another subject of the present invention is an ink jet recording sheet having on an ink-receiving support, in succession, an image preserving layer comprising an anionic colloidal silica and zinc oxide particulates with an average particle size of about 15 to 380 nm and a fixing layer comprising a cationic colloidal silica and a cationic polymer electrolyte.

DETAILED DESCRIPTION OF THE INVENTION

The support used in the present invention may be any of known supports capable of absorbing an ink containing a water-soluble dye, is preferably a support having an ink-receiving layer comprising a pigment and a binder on a base paper.

The image preserving layer formed on the ink-receiving layer mentioned before comprises zinc oxide particulates with an average particle size of about 15 to 380 nm, preferably about 20 to 300 nm, which absorbs UV light, and anionic colloidal silica, which is compatible with said particulates and can provide a glossy surface property in order to obtain compatibility between the light resistance and the high quality of recorded image.

Colloidal silica of this invention is the stabilized colloidal solution of silica to make its utilization easy, as described in Kagaku Binran (Chemical Reference Guide) published by Maruzen, Oct.15, 1986.

When the average particle size of zinc oxide particulates is less than 15 nm, the image-preserving layer is very closely packed and therefore has a poor ink absorbency, which not only makes it difficult to obtain images of high quality but also causes problems in cost and operability. On the other hand, when the average particle size is larger than 380 nm, the transparency of the image-preserving layer becomes worse due to light scattering thereby reducing the recorded density. The average particle size of zinc oxide particulates is measured by using a scanning electron microscope.

Since the surfaces of the zinc oxide particulates, which are necessary to impart light resistance, are negatively charged, the colloidal silica, which is necessary for glossy surface, needs to be anionic colloidal silica. Since the isoelectric point of anionic silica is usually around pH 2, the silica is negatively charged in the almost all range above pH 2, which is suitable for this invention. On the contrary, the colloidal silica that is reversely charged by having cations, for example, obtained by hydrolysis of metal salts, absorbed on the surface, has problems in operability due to poor compatibility with the zinc oxide particulates.

The configuration of the anionic colloidal silica is preferably non-spherical shape, in which several particulates interlink as in a shape of beads or a ring.

It is desirable that the coverage of the image-preserving layer be about 1 to 6 $g/m^2$, preferably about 1.5 to 5 $g/m^2$, on a dry solids basis. When the coverage of the image-preserving layer is less than 1 $g/m^2$, sufficient light resistance and surface gloss cannot be attained. On the other hand, when the coverage is larger than 6 g/m$^2$, the ink absorbency of the layer becomes poor and high quality images cannot be obtained.

The content of the zinc oxide particulates in the image-preserving layer is desired to be about 2 to 25 parts by weight, preferably about 3 to 20 parts by weight based on the 100 parts by weight of the anionic colloidal silica. When the content of the zinc oxide particulates is less than 2 parts by weight, sufficient light resistance cannot be attained. On the other hand, when the content is larger than 25 parts by weight, the recorded density and the surface gloss become poor and high quality images cannot be obtained.

Further, the 75 degree specular glossiness of the image preserving layer needs to be at least about 25%, preferably at least about 30% at the surface, measured in accordance with JIS(Japanese Industrial Standards) P8142, in order to obtain sufficient reproducibility of image similar to a silver salt film.

The base paper used for an ink-receiving support of the present invention can be made from various types of paper pulps. Examples of the pulp for paper include chemical pulp such as LBKP (hardwood bleached pulp) and NBKP (softwood bleached pulp), mechanical pulp such as GP(groundwood pulp) and TMP(thermo mechanical pulp), waste paper pulp and mixture thereof, but the pulp is not limited to those.

Various additives, such as fillers, sizing agents and paper reinforcing agents, can be added to the base paper, but the additives are not limited to those and can be selected from known fillers and known additives as required. Starch or other surface-sizing agents can be size pressed or coated. Further, antifoaming agents, pH regulators, pigments and coloring dyes for adjusting color, fluorescent pigments for improving visual whiteness and the like can be added as well.

It is desirable that the coverage of the ink-receiving layer formed on the base paper be about 5 to 25 g/m$^2$, preferably about 7 to 20 g/m$^2$, on a dry solids basis. When the coverage of the ink-receiving layer is less than 5 g/m$^2$, the ink absorbency of the layer becomes poor which will cause bleeding of ink. On the other hand, when the coverage is larger than 25 g/m$^2$, the amount of absorbed ink becomes excessive thereby reducing the recording density and this will also degrade the quality of image.

The ink-receiving layer comprises pigment and binder. For pigment, white pigment, such as light and heavy calcium carbonate, kaolin, clay, talc, titanium dioxide, zinc oxide, satin white, magnesium silicate, calcium silicate, aluminum silicate, aluminum hydroxide, alumina, quasi-boehmite, synthetic amorphous silica, magnesium carbonate, zeolite, is preferred. Among these, synthetic amorphous silica is more preferred as a pigment for the ink-receiving layer because it provides a superior combination of ink coloration, ink absorbency and cost.

The binder resin used for the ink-receiving layer can be selected from any resins that can bond strongly to the base paper and can form films when coated and dried. It is desirable to use starches such as oxidized starch, esterified starch, enzyme-modified starch and cationic starch; polyvinyl alcohol with various degrees of saponification and derivatives thereof; casein, soy proteins; cellulose derivatives such as carboxymethyl cellulose and hydroxymethyl cellulose; styrene-acrylic resin; isobutylene-maleic anhydride resin; acrylic emulsion; vinyl acetate emulsion; vinylidene chloride emulsion; polyester emulsion; styrene-butadiene latex; acrylonitrile-butadiene latex and the like.

A dye fixing agent that is cationic resin can be added to ink-receiving layer in order to impart water resistance property of the image. Examples of such agents include dicyandiamide-alkylamine polycondensed material, dicyanodiamide-formaldehyde polycondensed material, polyethylene-imine derivatives, alkylamine(-ammonium)-epichlorohydrin polycondensed material, polymethacrylic acid quaternary ammonium salt derivatives, polydiallyl-dimethyl-ammonium chloride, and other commercially available dye fixing agent. Mixtures of these can also be used without the loss of the advantage of the present invention.

The fixing layer of the present invention comprises cationic colloidal silica and cationic polymer electrolyte and provide a good combination of light resistance, water resistance and surface gloss. Further, it is preferred that the configuration of the cationic colloidal silica is non-spherical shape, in which several particulates interlink as in a shape of beads or a ring. When the fixing layer contains anionic colloidal silica or synthetic amorphous silica, problems are seen in operability due to the poor compatibility of the silica with the cationic polymer electrolyte.

It is desirable that the coverage of the fixing layer be about 1 to 6 g/m$^2$, preferably about 1.5 to 5 g/m$^2$, on a dry solids basis. When the coverage of the fixing layer is less than 1 g/m$^2$, sufficient water resistance and surface gloss cannot be attained. On the other hand, when the coverage is larger than 6 g/m$^2$, the ink absorbency of the layer becomes poor and high quality images cannot be obtained.

The content of the cationic polymer electrolyte in the fixing layer is desired to be about 2 to 25 parts by weight, preferably about 3 to 20 parts by weight based on the 100 parts by weight of the cationic colloidal silica. When the content of the cationic polymer electrolyte is less than 2 parts by weight, the water resistance is sometimes insufficient. On the other hand, when the content is larger than 25 parts by weight, the ink absorbency and light resistance sometimes degrades.

The cationic polymer electrolyte of the present invention can be selected from dicyandiamide-alkylamine polycondensed material, dicyanodiamide-formaldehyde polycondensed material, polyethylene-imine derivatives, alkylamine (-ammonium)-epichlorohydrin polycondensed material, polymethacrylic acid quaternary ammonium salt derivatives, polydiallyl-dimethyl-ammonium chloride, other commercially available cationic polymer electrolyte and mixture thereof.

By applying the fixing layer comprising cationic colloidal silica and cationic polymer electrolyte as a top layer, it becomes possible to obtain compatibility between water resistance and quality of recorded images. In order to get a reproducibility of images comparable to silver-salt films, the 75 degree specular glossiness is desirably at least about 30%, preferably at least about 35% at the surface of the fixing layer, measured in accordance with JIS(Japanese Industrial Standards) P8142.

Further, the ink-receiving layer may comprise hindered amine compounds of amino ether type having alkoxyl groups in order to impart light resistance. Suitable hindered amine compounds are represented by formula (1) below:

(1)

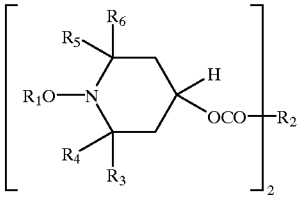

wherein $R_1$ is $C_nH_{2n+1}$ (n=1 to 14), $R_2$ is $C_nH_{2n}$ (n=1 to 14) and $R_3$ to $R_6$ are each an alkyl group or carbonyl group. Benzotriazole compounds may be used together to improve the light resistance further.

The n in $R_1$ and $R_2$ of the formula (1) is preferably 6 to 10, and the alkyl group or carbonyl group of $R_3$ to $R_6$ is preferably a lower alkyl group with 1 to 4 carbons, more preferably methyl group.

The hindered amine compound of the amino ether type having alkoxyl groups is preferably bis-(2,2,6,6-tetramethyl-1-(octyloxy)-4-piperidinyl) sebacate wherein $R_1$ is $C_8H_{17}$, $R_2$ is $C_8H_{16}$ and $R_3$ to $R_6$ are methyl groups in the formula (1) (Tinuvin 123, manufactured by Ciba Specialty Chemicals, Inc.).

Hindered amine compounds generally generate nitroxy radicals by reacting with hydroperoxide or triplet oxygen in the air, which further react to form aminoethers by capturing polymer radicals generated by photodegradation of dyes contained in ink. Then the generated aminoethers react with peroxy radicals generated by a reaction between polymer radicals and oxygen in the air to regenerate nitroxy radicals. The aminoether also releases olefins, simultaneously generating hydroxylamine that react with the peroxy radicals to regenerate nitroxy radicals. This process is repeated to capture the radicals and hamper a chain reaction, thereby preventing the image from photodegrading.

Since the hindered amine compounds of the present invention have an amino ether as part of their chemical structure, it is considered that peroxy radicals are immediately captured when generated. Thus the hindered amine compound is very effective in preventing photodegradation of image. While in the case of conventional hindered amine compounds unsubstituted or substituted by alkyl or acetyl groups, it is considered that there is a large energy barrier to producing aminoethers, which inhibit the effective prevention of photodegradation.

The content of the hindered amine compounds in the ink-receiving layer is desired to be about 0.5 to 15 wt %, preferably about 2 to 8 wt %. When the content of the compounds is less than 0.5 wt %, the addition of the compounds would not be effective, and when the content is larger than 15 wt %, the applicability in manufacturing becomes worse.

The benzotriazole compounds of the present invention preferably include, for example, 2-(2-hydroxy-3,5-di-t-amylphenyl-2H-benzotriazole, iso-octyl-3,3-(2H-benzotriazole-2-yl)-5-t-butyl-4-hydroxyphenylpropionate, 2-[2-hydroxy-3,5-di(1,1-dimethylbenzyl)phenyl]-2H-benzotriazole, 2-(2'-hydroxy-3'-t-butyl-5'-methylphenyl)-5-chlorobenzotriazole, and the like.

The content of the benzotriazole compounds in the ink-receiving layer is desired to be about 0.5 to 12 wt %, preferably about 2.5 to 8 wt %. When the content of the benzotriazole compounds is less than 0.5 wt %, the addition of the compounds would not be effective, and when the content is larger than 12 wt %, it causes significant coloring in the applied layer.

The coating compositions for the ink-receiving layers, image-preserving layers and fixing layers may contain various additives, such as an antifoaming agent, a surface-sizing agent, a pH-adjusting agent, other UV absorber, an antioxidant, a dye or coloring pigment for adjusting color phase, a fluorescent dye and mixture thereof without the loss of the effect of the present invention.

The method of coating the ink-receiving layers, image-preserving layers and fixing layers on base paper includes conventional coaters of various kinds, e.g., a blade coater, an air knife coater, a roll coater, a curtain coater, a bar coater, a gate roll coater and a gravure coater and the like. Further various calendering treatments such as a machine calender, a soft calender, and a super calender can be used solely or in combination for finishing the surface.

The ink jet recording sheet of the present invention has on an ink-receiving support, in succession, an image preserving layer comprising zinc oxide particulates with a certain particular size to absorb UV light and anionic colloidal silica that is compatible with the particulates and a fixing layer comprising cationic colloidal silica to impart water resistance and surface gloss. Therefore, said ink jet recording sheet not only has superior ink absorbency and ink coloration, but also has superior light resistance, water resistance and surface gloss, therefore the ink jet recording paper is of extremely high quality.

The present invention will now be illustrated in more detail by reference to the following examples, but it should be understood that these examples are not to be construed as limiting the scope of the present invention in any way.

EXAMPLES

The average primary particle size of colloidal silica is measured by BET method, the average secondary particle length of non-spherical cationic colloidal silica is measured by laser scattering method. The ink jet recording sheets in the following examples and comparative examples are evaluated by the following method. Unless otherwise noted, all "parts" are by weight in the following examples and comparative examples. The weight in the coating solution is based on dry basis, excluding water.

(1) 75 degree specular glossiness

The 75 degree specular glossiness is determined by using a glossimeter, GM-26D (trade name, a product of Murakami Shikisai Kenkyujo), in accordance to JIS P8142.

(2) ink jet recording properties

The predetermined solid pattern or image pattern is printed on the test sheet by an ink jet printer, Model PM750C (trade name, a product of Seiko Epson Corp.) and the various properties of the recorded sheet is evaluated by the following method:

a. Recorded Density

As to the densities of recorded images, the reflection densities of the black solid areas are measured with a Macbeth densitometer, RD 915 (trade name, a product of Macbeth Limited).

b. Light Resistance

The recorded density of magenta ink is measured after being tested for 25 hours by Xenon Weather Meter SC700-WN (trade name, a product of Suga Test Machinery Limited), and evaluated the remaining recorded density compared with the density before the test according to the ranks mentioned below;

◎: Percentage of remaining recorded density is more than 90%.
○: Percentage of remaining recorded density is 70 to 90%.
Δ: Percentage of remaining recorded density is 50 to 70%.
X: Percentage of remaining recorded density is less than 50%.

c. Ink Absorbency

The ink absorbency is evaluated by an extent of bleeding at the boundary between image areas of solid magenta and solid green (mixture of cyan and yellow) according to the ranks mentioned below;

◎: No bleeding is observed at the boundaries.
○: Almost no bleeding is observed at the boundaries.
Δ: Some bleeding is observed at the boundaries.
X: Significant bleeding is observed at the boundaries.

d. Water Resistance

The recorded image is dried in the air for 1 day, then is immersed in a tap water at 20 degree C. for 5 minutes and dried in the air again. Then the extent of change of recorded images is evaluated according to the ranks mentioned below;

◎: No change is observed.
○: Slight change is observed.
Δ: Some change is observed.
X: Most of the image bleed.

Example 1

A slurry consisting of 93 parts of LBKP (hardwood bleached pulp) with a freeness of 440 ml, 7 parts of NBKP(softwood bleached pulp) with a freeness of 520 ml, 7 parts of talc, 1.5 parts of sulfuric acid band (aluminum sulfate), 0.4 parts of sizing agent and 0.02 parts of yield improver is prepared. Paper is manufactured from the slurry by a twin wire machine and pre-dried by a cylinder drier. Then the coating solution 1 below is applied to the paper by a two roll sizing press to have a total solid coverage of both sides of 4 g/m$^2$ and is subjected to a machine calender treatment. A base paper with a dry coverage of 157 g/m$^2$ and a smoothness of 35 seconds is obtained.

Coating Solution 1

| | |
|---|---|
| Water soluble polymer: oxidized starch MS#3600(Nihon Shokuhin Kakou) | 100 parts |
| Surface sizing agent: Hamacoat S-200L(Misawa Ceramics) | 2 parts |
| Antifoaming agent: Nopco 8034L(Sun-Nopco) | 0.1 parts |
| Water | 900 parts |

The coating solution 2 below is coated on one surface of the obtained base paper by means of a Mayer bar so as to have a dry coverage of 13 g/m$^2$. The paper is then subjected to a calendering machine with a linear pressure of 80 Kg/cm to produce an ink-receiving layer. Then an image-preserving layer is formed by coating the coating solution 3 below on the ink-receiving layer by means of a Mayer bar so as to have a dry coverage of 2 g/m$^2$ and then calendered at a linear pressure of 100 Kg/cm. An ink jet recording sheet with a dry coverage of 172 g/m$^2$ is obtained.

Coating Solution 2

| | |
|---|---|
| Synthetic amorphous silica: Fineseal X-37B(Tokuyama) | 100 parts |
| Water soluble polymer: PVA-117(Kurarey Co., Ltd.) | 15 parts |
| Dye fixing agent: PAS-H-10L(Nitto Boseki) | 5 parts |

-continued

| | |
|---|---|
| Antifoaming agent: SN defoamer 480(Sun-Nopco) | 0.1 parts |
| Water | 550 parts |

Coating Solution 3

| | |
|---|---|
| Non-spherical anionic colloidal silica: Snowtex UP with an average primary particle size of 10 to 20 nm and an average secondary particle length of 50 to 300 nm (Nissan Chemical) | 100 parts |
| Zinc oxide particulates: FINEX-50 with an average particle size of 20 nm(Sakai Chemical) | 5 parts |
| Antifoaming agent: KM-72F (Shin-Etsu Chemical) | 0.1 parts |
| Water | 420 parts |

Example 2

The ink jet recording sheet is obtained in the same manner as in Example 1, except that Fine Zinc Oxide (registered trade mark of Honjo Chemical) with an average particle size of 200 nm is used for zinc oxide particulates in the coating solution 3.

Example 3

The ink jet recording sheet is obtained in the same manner as in Example 1, except that the content of the zinc oxide particulates is 15 parts in the coating solution 3.

Example 4

The ink jet recording sheet is obtained in the same manner as in Example 1, except that the dry coverage of the coating solution 3 is 4.5 g/m$^2$.

Example 5

The ink jet recording sheet is obtained in the same manner as in Example 1, except that the dry coverage of the coating solution 3 is 10 g/m$^2$.

Example 6

The ink jet recording sheet is obtained in the same manner as in Example 1, except that the coating solution 2 is not applied.

Comparative Example 1

The ink jet recording sheet is obtained in the same manner as in Example 1, except that Hydrozincite No.1 (registered trade mark of Sakai Chemical) with an average particle size of 520 nm is used for zinc oxide particulates in the coating solution 3.

Comparative Example 2

The ink jet recording sheet is obtained in the same manner as in Example 1, except that FINEX-75 (a product of Sakai Chemical) with an average particle size of 10 nm is used for zinc oxide particulates in the coating solution 3.

Comparative Example 3

The ink jet recording sheet is obtained in the same manner as in Example 1, except that the coating solution 3 is not applied.

Comparative Example 4

The ink jet recording sheet is obtained in the same manner as in Example 1, except that the zinc oxide particulates is not formulated in the coating solution 3.

Comparative Example 5

The ink jet recording sheet is obtained in the same manner as in Example 1, except that the colloidal silica is not formulated in the coating solution 3.

Comparative Example 6

The ink jet recording sheet is obtained in the same manner as in Example 1, except that Synthetic amorphous silica, Fineseal X-37B(Tokuyama), is used for the colloidal silica in the coating solution 3.

The evaluation results for Examples 1 to 6 and Comparative examples 1 to 6 are summarized in Table 1 below. The ink jet recording sheets ranked by ⊙ or ○ can be used without causing problems.

TABLE 1

| | 75 degree specular | ink jet recording properties | | |
|---|---|---|---|---|
| | glossiness (%) | recorded density | light resistance | ink absorbency |
| Example 1 | 35.8 | 2.10 | ⊙ | ⊙ |
| Example 2 | 30.8 | 2.01 | ⊙ | ⊙ |
| Example 3 | 30.4 | 1.95 | ⊙ | ⊙ |
| Example 4 | 41.7 | 1.99 | ⊙ | ⊙ |
| Example 5 | 43.6 | 2.06 | ⊙ | ○ |
| Example 6 | 30.5 | 1.98 | ⊙ | ○ |
| Comparative Example 1 | 19.4 | 1.62 | Δ | ○ |
| Comparative Example 2 | 44.1 | 1.90 | ⊙ | Δ |
| Comparative Example 3 | 7.8 | 1.84 | x | ⊙ |
| Comparative Example 4 | 45.8 | 2.08 | x | ○ |
| Comparative Example 5 | 8.3 | 1.60 | Δ | ○ |
| Comparative Example 6 | 8.3 | 1.79 | Δ | ⊙ |

Example 7

A slurry consisted of 93 parts of LBKP with a freeness of 440 ml (csf), 7 parts of NBKP with a freeness of 520 ml (csf), 7 parts of talc, 1.5 parts of sulfuric acid band, 0.4 parts of sizing agent and 0.02 parts of yield improver is prepared. Then a paper is manufactured from the slurry by a twin wire machine and pre-dried by a cylinder drier. Then oxidized starch is applied to the both sides of the paper by a two roll sizing press to have a total solid coverage of both sides of 4 g/m$^2$, followed by a machine calender treatment. A base paper with a dry coverage of 160 g/m$^2$ and a smoothness of 35 seconds is obtained.

Then the coating solution 4 below is coated on one surface of the obtained base paper by means of a Mayer bar so as to have a dry coverage of 16 g/m$^2$. The paper is then subjected to a calendering machine with a linear pressure of 80 Kg/cm to form an ink-receiving layer. To form an image preserving layer, coating solutions 5 and 6 below are coated successively on the ink-receiving layer by means of a Mayer bar so as to have a dry coverage of 2 g/m$^2$ each to form a image-preserving layer and a fixing layer, and the paper is subjected to a calendering machine with a linear pressure of 100 Kg/cm. An ink jet-recording sheet with a dry coverage of 180 g/m$^2$ is obtained.

Coating Solution 4

| | |
|---|---|
| Synthetic amorphous silica: Fineseal X-37B with an average secondary particle size of 4 μm (Tokuyama) | 100 parts |
| Polyvinyl alcohol: PVA-117 (Kurarey Co., Ltd.) | 20 parts |

-continued

| | |
|---|---|
| Dye fixing agent (quaternary ammonium salt type polymer) | 5 parts |
| Water | 550 parts |

Coating Solution 5

| | |
|---|---|
| Spherical anionic colloidal silica: Snowtex 20 with an average primary particle size of 10 to 20 nm (Nissan Chemical) | 100 parts |
| Zinc oxide particulates with an average particle size of 20 nm | 5 parts |
| Water | 420 parts |

Coating Solution 6

| | |
|---|---|
| Non-spherical (beads type) cationic colloidal silica: Snowtex OUP with an average primary particle size of 10 to 20 nm and secondary particle length of 50 to 300 nm (Nissan Chemical) | 100 parts |
| Cationic polymer electrolyte (quaternary ammonium salt type polymer) | 5 parts |
| Water | 550 parts |

Example 8

The ink jet recording sheet is obtained in the same manner as in Example 7, except that the average particle size of the zinc oxide particulate is 200 nm in coating solution 5.

Example 9

The ink jet recording sheet is obtained in the same manner as in Example 7, except that the content of the zinc oxide particulates is 15 parts in coating solution 5.

Example 10

The ink jet recording sheet with a dry coverage of 182.5 g/m$^2$ is obtained in the same manner as in Example 7, except that the dry coverage of coating solution 5 is 4.5 g/m$^2$.

Example 11

The ink jet recording sheet with a dry coverage of 188 g/m$^2$is obtained in the same manner as in Example 7, except that the dry coverage of coating solution 5 is 10 g/m$^2$.

Example 12

The ink jet recording sheet with a dry coverage of 164 g/m$^2$ is obtained in the same manner as in Example 7, except that coating solution 4 is not applied.

Example 13

The ink jet recording sheet is obtained in the same manner as in Example 7, except that spherical cationic colloidal silica Snowtex O with an average primary particle size of 10 to 20 nm (Nissan Chemical) is used for the non-spherical (beads type) cationic colloidal silica in coating solution 6.

Comparative Example 7

The ink jet recording sheet is obtained in the same manner as in Example 7, except that zinc oxide particulates with an average particle size of 520 nm is used for zinc oxide particulates in coating solution 5.

Comparative Example 8

The ink jet recording sheet is obtained in the same manner as in Example 7, except that zinc oxide particulates with an average particle size of 10 nm is used for the zinc oxide particulates in coating solution 6.

Comparative Example 9

The ink jet recording sheet with a dry coverage of 178 g/m$^2$ is obtained in the same manner as in Example 7, except that coating solution 5 is not applied.

Comparative Example 10

The ink jet recording sheet is obtained in the same manner as in Example 7, except that the spherical anionic colloidal silica is not formulated in coating solution 5.

Comparative Example 11

The ink jet recording sheet is obtained in the same manner as in Example 7, except that the zinc oxide particulate is not formulated in coating solution 5.

Comparative Example 12

The ink jet recording sheet is obtained in the same manner as in Example 7, except that the non-spherical cationic colloidal silica is not formulated in coating solution 6.

Comparative Example 13

The ink jet recording sheet is obtained in the same manner as in Example 7, except that the cationic polymer electrolyte is not formulated in coating solution 6.

Comparative Example 14

The ink jet recording sheet is obtained in the same manner as in Example 7, except that synthetic amorphous silica with an average secondary particle size of 4 $\mu$m, Fineseal X-37B (Tokuyama), is used for the spherical anionic colloidal silica in coating solution 5.

The evaluation results for Examples 7 to 13 and Comparative examples 7 to 14 are summarized in Table 2 below. The ink jet recording sheets ranked by ⊙ or ○ can be used without causing problems.

TABLE 2

| | 75 degree specular | ink jet recording properties | | | |
|---|---|---|---|---|---|
| | glossiness (%) | recorded density | light resistance | ink absorbency | water resistance |
| Example 7 | 40.6 | 2.21 | ⊙ | ⊙ | ⊙ |
| Example 8 | 39.5 | 2.14 | ⊙ | ⊙ | ⊙ |
| Example 9 | 36.0 | 2.01 | ⊙ | ⊙ | ⊙ |
| Example 10 | 43.9 | 2.20 | ⊙ | ⊙ | ⊙ |
| Example 11 | 47.8 | 2.15 | ○ | ○ | ⊙ |
| Example 12 | 37.2 | 1.97 | ⊙ | ○ | ○ |
| Example 13 | 46.1 | 2.06 | ○ | ○ | ⊙ |
| Comparative Example 7 | 23.9 | 1.81 | Δ | ○ | ○ |
| Comparative Example 8 | 44.4 | 2.15 | ⊙ | Δ | ⊙ |
| Comparative Example 9 | 29.5 | 2.04 | x | ⊙ | ⊙ |
| Comparative Example 10 | can not be measured because of weakness of image-preserving layer | | | | |
| Comparative | 43.2 | 1.89 | x | ⊙ | ⊙ |

TABLE 2-continued

| | 75 degree specular | ink jet recording properties | | | |
|---|---|---|---|---|---|
| | glossiness (%) | recorded density | light resistance | ink absorbency | water resistance |
| Example 11 | | | | | |
| Comparative Example 12 | 20.5 | 1.92 | ⊙ | Δ | ○ |
| Comparative Example 13 | 41.5 | 2.00 | ⊙ | ○ | Δ |
| Comparative Example 14 | 19.2 | 1.79 | Δ | ⊙ | ○ |

It is obvious from Tables 1 and 2 that the ink jet recording sheet of the present invention provides a superior combination of ink absorbency, ink coloration, light resistance, water resistance and surface gloss even when printed with an ink containing a water-soluble dye.

Example 14

The ink jet recording sheet is obtained in the same manner as in Example 1, except that coating solution 7 below is used instead of coating solution 2.

Coating Solution 7

| | |
|---|---|
| Synthetic amorphous silica: Fineseal X-37B(Tokuyama) | 100 parts |
| Water soluble polymer: PVA-117(Kurarey Co., Ltd.) | 15 parts |
| Dye fixing agent: PAS-H-10L(Nitto Boseki) | 5 parts |
| Hindered amine compound: bis-(2,2,6,6-tetramethyl-1-(octyloxy)-4-piperidinyl)sebacate (Tinuvin 123, manufactured by Ciba Specialty Chemicals, Inc.) | 3 parts |
| Benzotriazole compound: Tinuvin 900 (Ciba Specialty Chemicals Inc.) | 10 parts |
| Antifoaming agent: SN defoamer 480(Sun-Nopco) | 0.1 parts |
| Water | 550 parts |

Example 15

The ink jet recording sheet is obtained in the same manner as in Example 14, except that the content of the hindered amine compound (Tinuvin 123) is 10 parts in the coating solution 7.

Example 16

The ink jet recording sheet is obtained in the same manner as in Example 14, except that the benzotriazole compound is omitted from coating solution 7.

Example 17

The ink jet recording sheet is obtained in the same manner as in Example 7, except that coating solution 7 is used for the coating solution 4.

Example 18

The ink jet recording sheet is obtained in the same manner as in Example 17, except that the content of the hindered amine compound (Tinuvin 123) is 10 parts in coating solution 7.

Example 19

The ink jet recording sheet is obtained in the same manner as in Example 17, except that the benzotriazole compound is omitted from coating solution 7.

Comparative Example 15

An ink jet recording sheet is obtained in the same manner as in Example 17, except that Tinuvin 144 (Ciba Specialty Chemicals, Inc.) of the formula (2) below is used instead of the hindered amine compound (Tinuvin 123) in coating solution 7.

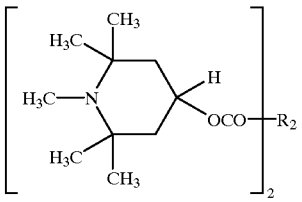

where $R_2$ is

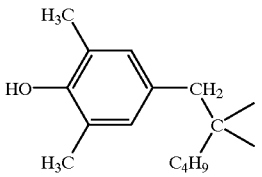

Comparative Example 16

The ink jet recording sheet is obtained in the same manner as in Example 17, except that Tinuvin 292 (Ciba Specialty Chemicals, Inc.) of the formula (3) below is used for the hindered amine compound (Tinuvin 123) in coating solution 7.

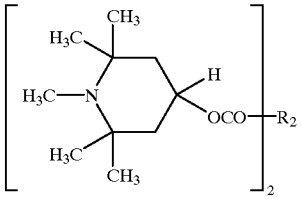

where $R_2$ is $C_8H_{16}$.

It is obvious from Examples 14 to 19 that the light resistance is further improved by formulating Tinuvin 123, hindered amine compound of amino ether type having alkoxyl groups of formula (1), in the ink-receiving layer. The light resistance is further improved by formulating benzotriazole compound in the ink-receiving layer. On the other hand, in comparative examples 15 and 16, formulating hindered amine compound of formula (2) or (3), there is not such improvement in light resistance as in examples 14 to 19.

What is claimed is:

1. An ink jet recording sheet having on an ink-receiving support an image preserving layer comprising anionic colloidal silica and zinc oxide particulates with an average particle size of about 15 to 380 nm, wherein said sheet has a 75 degree specular glossiness of at least about 25% at the surface.

2. An ink jet recording sheet as in claim 1, wherein the amount of said zinc oxide particulates is about 2 to 25 parts by weight based on 100 parts by weight of said anionic colloidal silica.

3. An ink jet recording sheet as in claim 2, wherein the coverage of said image-preserving layer is about 1 to 6 g/m$^2$ on a dry solids basis.

4. An ink jet recording sheet as in claim 3, wherein said ink-receiving support has an ink-receiving layer comprising at least a pigment and a binder on a base paper.

5. An ink jet recording sheet as in claim 4, wherein the coverage of said ink-receiving layer is about 5 to 25 g/m$^2$ on a dry solids basis.

6. An ink jet recording sheet as in claim 1, wherein said ink-receiving support has an ink-receiving layer comprising at least a pigment and a binder on a base paper.

7. An ink jet recording sheet as in claim 6, wherein said ink-receiving layer comprises hindered amine compound of amino ether type having alkoxyl groups of formula (1) below:

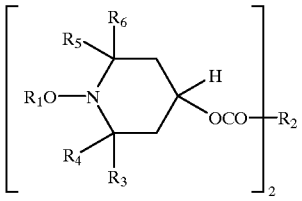

wherein $R_1$ is $C_nH_{2n+1}$ (n=1 to 14), $R_2$ is $C_nH_{2n}$ (n=1 to 14), and $R_3$ to $R_6$ are alkyl group or carbonyl group.

8. An ink jet recording sheet as in claim 7, wherein said ink-receiving layer further comprises a benzotriazole compound.

9. An ink jet recording sheet having on an ink-receiving support, in succession, an image preserving layer comprising anionic colloidal silica and zinc oxide particulates with an average particle size of about 15 to 380 nm and a fixing layer comprising cationic colloidal silica and cationic polymer electrolyte.

10. An ink jet recording sheet as in claim 9, wherein the amount of said zinc oxide particulates is about 2 to 25 parts by weight based on 100 parts by weight of said anionic colloidal silica.

11. An ink jet recording sheet as in claim 10, wherein the configuration of said anionic colloidal silica in the fixing layer is non-spherical shape, in which several particulates interlink.

12. An ink jet recording sheet as in claim 11, wherein the 75 degree specular glossiness is at least about 30% at the surface.

13. An ink jet recording sheet as in claim 12, wherein the coverage of said image-preserving layer is about 1 to 6 g/m$^2$ on a dry solids basis and the coverage of said fixing layer is about 1 to 6 g/m$^2$ on a dry solids basis.

14. An ink jet recording sheet as in claim 13, wherein said ink-receiving support has an ink-receiving layer comprising at least a pigment and a binder on a base paper.

15. An ink jet recording sheet as in claim 14, wherein the coverage of said ink-receiving layer is about 5 to 25 g/m$^2$ on a dry solids basis.

16. An ink jet recording sheet as in claim 9, wherein the configuration of said anionic colloidal silica in the fixing layer is non-spherical shape, in which several particulates interlink.

17. An ink jet recording sheet as in claim 9, wherein the 75 degree specular glossiness is at least about 30% at the surface.

18. An ink jet recording sheet as in claim 9, wherein said ink-receiving support has an ink-receiving layer comprising at least a pigment and a binder on a base paper.

19. An ink jet recording sheet as in claim 18, wherein said ink-receiving layer comprises hindered amine compounds of amino ether type having alkoxyl groups of formula (1) below:

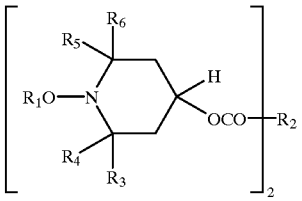

wherein $R_1$ is $C_nH_{2n+1}$ (n=1 to 14), $R_2$ is $C_nH_{2n}$ (n=1 to 14), and $R_3$ to $R_6$ are alkyl group or carbonyl group.

20. An ink jet recording sheet as in claim 19, wherein said ink-receiving layer further comprises a benzotriazole compound.

* * * * *